US010526719B2

(12) United States Patent
Tsai et al.

(10) Patent No.: US 10,526,719 B2
(45) Date of Patent: Jan. 7, 2020

(54) MAGNETIC STRUCTURE FOR METAL PLATING CONTROL

(71) Applicant: Taiwan Semiconductor Manufacturing Company Limited, Hsin-Chu (TW)

(72) Inventors: Ming-Chin Tsai, Hsinchu (TW); Chung-En Kao, Toufen Township (TW); Victor Y. Lu, Hsinchu (TW)

(73) Assignee: Taiwan Semiconductor Manufacturing Company Limited, Hsin-Chu (TW)

( * ) Notice: Subject to any disclaimer, the term of this patent is extended or adjusted under 35 U.S.C. 154(b) by 639 days.

(21) Appl. No.: 13/971,881

(22) Filed: Aug. 21, 2013

(65) Prior Publication Data

US 2015/0053563 A1 Feb. 26, 2015

(51) Int. Cl.

| | |
|---|---|
| ***C25D 17/00*** | (2006.01) |
| ***C25D 5/00*** | (2006.01) |
| ***C25D 7/12*** | (2006.01) |

(52) U.S. Cl.

CPC ..... *C25D 17/007* (2013.01); *C25D 5/006* (2013.01); *C25D 7/123* (2013.01); *C25D 17/001* (2013.01)

(58) Field of Classification Search

CPC .. C25D 5/006; C25D 5/024; C25D 7/12–123; C25D 17/001; H01F 7/0247

See application file for complete search history.

(56) References Cited

U.S. PATENT DOCUMENTS

| | | | | |
|---|---|---|---|---|
| 7,622,024 | B1 | 11/2009 | Mayer et al. | |
| 2003/0038034 | A1* | 2/2003 | Griego | B82Y 25/00 205/89 |
| 2004/0007467 | A1* | 1/2004 | McHugh | C25D 5/18 205/102 |
| 2006/0027460 | A1* | 2/2006 | Chang | C25D 5/18 205/104 |

(Continued)

FOREIGN PATENT DOCUMENTS

| | | | | |
|---|---|---|---|---|
| JP | 2002146593 A | * | 5/2002 | |
| JP | 2006-89797 A | * | 4/2006 | C25D 5/00 |

OTHER PUBLICATIONS

Osada Machine Translation, JP 2006-089797 A (2006).*
Yutaka Kasuya, machine translation JP-2002146593-A (Year: 2002).*

*Primary Examiner* — Brian W Cohen
*Assistant Examiner* — Ho-Sung Chung
(74) *Attorney, Agent, or Firm* — Cooper Legal Group, LLC

(57) ABSTRACT

Among other things, one or more systems and techniques for promoting metal plating profile uniformity are provided. A magnetic structure is positioned relative to a semiconductor wafer that is to be electroplated with metal during a metal plating process. In an embodiment, the magnetic structure applies a force that decreases an edge plating current by moving metal ions away from a wafer edge of the semiconductor wafer. In an embodiment, the magnetic structure applies a force that increases a center plating current by moving metal ions towards a center portion of the semiconductor wafer. In this way, the edge plating current has a current value that is similar to a current value of the center plating current. The similarity between the center plating current and the edge plating current promotes metal plating uniformity.

20 Claims, 7 Drawing Sheets

(56) References Cited

U.S. PATENT DOCUMENTS

| | | | | |
|---|---|---|---|---|
| 2006/0207885 | A1* | 9/2006 | Basol | C25D 5/022 205/137 |
| 2007/0062816 | A1* | 3/2007 | Chung | H05K 3/241 205/89 |
| 2008/0083624 | A1* | 4/2008 | Kim | H01L 21/2885 205/89 |
| 2009/0050486 | A1* | 2/2009 | Flotta | C25D 17/00 205/89 |
| 2010/0038252 | A1* | 2/2010 | Kasuya | C25D 3/562 205/89 |
| 2011/0042223 | A1* | 2/2011 | Kruglick | C25D 5/006 205/89 |
| 2011/0203734 | A1* | 8/2011 | Koji | C23C 14/14 156/345.24 |

* cited by examiner

MAGNETIC STRUCTURE FOR METAL PLATING CONTROL

BACKGROUND

A metal plating process is performed for electroplating metal onto a semiconductor wafer, such as within trenches, via structures, or other portions of the semiconductor wafer. In an example, a seed layer, such as a copper layer, is formed over a surface of the semiconductor wafer. The seed layer carries electrical plating current from a wafer edge of the semiconductor wafer across the surface of the semiconductor wafer. The electrical plating current is supplied by a power source that is connected to an anode and is connected to the wafer edge as a cathode. The electrical plating current provides electrons that convert metal ions to metal atoms that accumulate on the surface of the semiconductor wafer. The seed layer has a resistance from the wafer edge to a center region of the semiconductor wafer, which results in a voltage drop causing a terminal effect where the electrical plating current is higher at the wafer edge than the center region. The higher electrical plating current results in a greater accumulation of metal atoms at the wafer edge than the center region, thus resulting in non-uniformity issues across the wafer.

DETAILED DESCRIPTION

Figure 1:
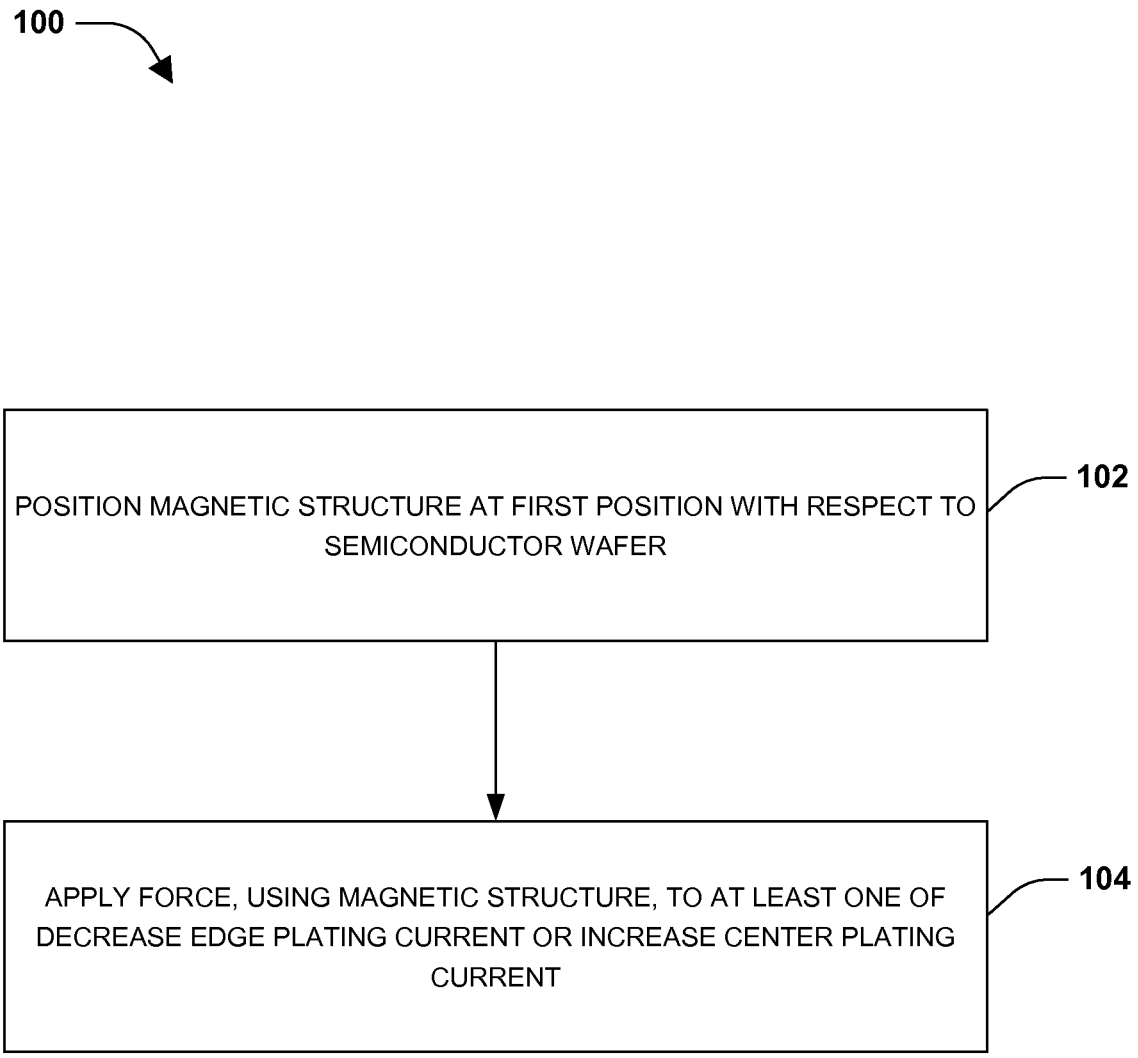
FIG. 1 is a flow diagram illustrating a method of promoting metal plating profile uniformity, according to some embodiments.

The claimed subject matter is now described with reference to the drawings, wherein like reference numerals are generally used to refer to like elements throughout. In the following description, for purposes of explanation, numerous specific details are set forth in order to provide an understanding of the claimed subject matter. It is evident, however, that the claimed subject matter can be practiced without these specific details. In other instances, structures and devices are illustrated in block diagram form in order to facilitate describing the claimed subject matter.

One or more systems and methods for promoting metal plating profile uniformity are provided herein. A magnetic structure, such as a permanent magnet or an electromagnet, is used to modify electrical plating current so that the electrical plating current is substantially uniform across a surface of a semiconductor wafer during a metal plating process. Controlling the electrical plating current compensates for a resistance across the surface of the semiconductor wafer that would otherwise result in a relatively larger edge plating current than a center plating current, at times referred to as a terminal effect. The terminal effect results in more metal atom accumulating on a wafer edge of the semiconductor wafer than a center portion of the semiconductor wafer. In this way, maintaining a similar electrical plating current for the semiconductor wafer mitigates the terminal effect, and thus promotes uniform metal plating across the surface of the semiconductor wafer.

A method 100 of promoting metal plating profile uniformity is illustrated in FIG. 1. In an embodiment, a seed layer, such as a copper layer, is formed over a surface of a semiconductor wafer. The semiconductor wafer is placed into a container, such as a plating cell, within which a metal plating process is performed to electroplate metal onto the semiconductor wafer. The plating cell comprises an electrolyte solution that facilitates the metal plating process. An electrical plating current is supplied to the plating cell so that the electrical plating current provides electrons that convert metal ions, within the electrolyte solution, to metal atoms that accumulate on the surface of the semiconductor wafer. Because the seed layer creates a resistance between a wafer edge and a center portion of the semiconductor wafer, a voltage drop occurs between the wafer edge and center portion. The voltage drop results in a decreased center plating current with respect to an edge plating current. The decreased center plating current results in relatively less accumulation of metal atoms at the center portion compared to metal atom accumulation at the wafer edge. The difference in metal atom accumulation or metallization between the wafer edge and the center portion results in the semiconductor wafer having non-uniformity issues. Accordingly, as provided herein, a magnet structure is used to control the electrical plating current during the metal plating process so that the edge plating current and the center plating current have relatively similar current values.

At 102, the magnet structure is positioned at a first position with respect to the semiconductor wafer. In an embodiment, the magnet structure is positioned outside the plating cell (e.g., FIG. 2A). In an embodiment, the magnet structure is positioned inside the plating cell (e.g., FIG. 3A). In an embodiment, the magnet structure is positioned surrounding the plating cell or surrounding the semiconductor wafer (e.g., FIG. 3A or FIG. 4A). The magnet structure is configured as a single structure (e.g., FIG. 3A) or is configured as a plurality of magnetic portions (e.g., FIG. 4A).

At 104, the magnetic structure is used to apply a force to the electrical plating current. In an embodiment, the force is applied to metal ions to move the metal ions away from the wafer edge of the semiconductor wafer. Moving the metal ions away from the wafer edge decreases an edge plating current associated with the wafer edge. In this way, the edge plating current is modified to a current value similar to a current value of the center plating current. In an embodiment, the force is applied to metal ions to move the metal ions towards the center portion of the semiconductor wafer. Moving the metal ions towards the center portion increases a center plating current associated with the center portion. In this way, the center plating current is modified to a current value similar to a current value of the edge plating current. Because the center plating current and the edge plating current have similar current values, metal atoms accumulate on the surface of the semiconductor wafer in a uniform or conformal manner so that the wafer edge and the center portion have similar thicknesses. It is appreciated that an embodiment of a center plating current 454 and an edge plating current 452 is illustrated in FIG. 4B.

In an embodiment, the magnetic structure is rotated with respect to the semiconductor wafer. A rotational speed of the magnetic structure is modifiable during the metal plating process. In an embodiment, a position of the magnetic structure is modified from the first position to a second position with respect to the semiconductor wafer. The difference in the first position and the second position corresponds to a change in horizontal distance between the magnetic structure and the center portion of the semiconductor wafer or corresponds to a vertical distance between the magnetic structure and the surface of the semiconductor wafer. The magnetic structure is moved in a horizontal, vertical direction, or any other direction during the metal plating process. In an embodiment, a magnetic strength of the magnet structure is modified during the metal plating process, such as by adding or removing a number of permanent magnets or by changing a power setting of an electromagnet. The magnetic strength is changed to adjust a metal plating profile resulting from the metal plating process. In this way, the magnetic structure is used to control electrical plating current in a manner that promotes metal plating profile uniformity or any other desired metal plating profile.

Figure 2A:
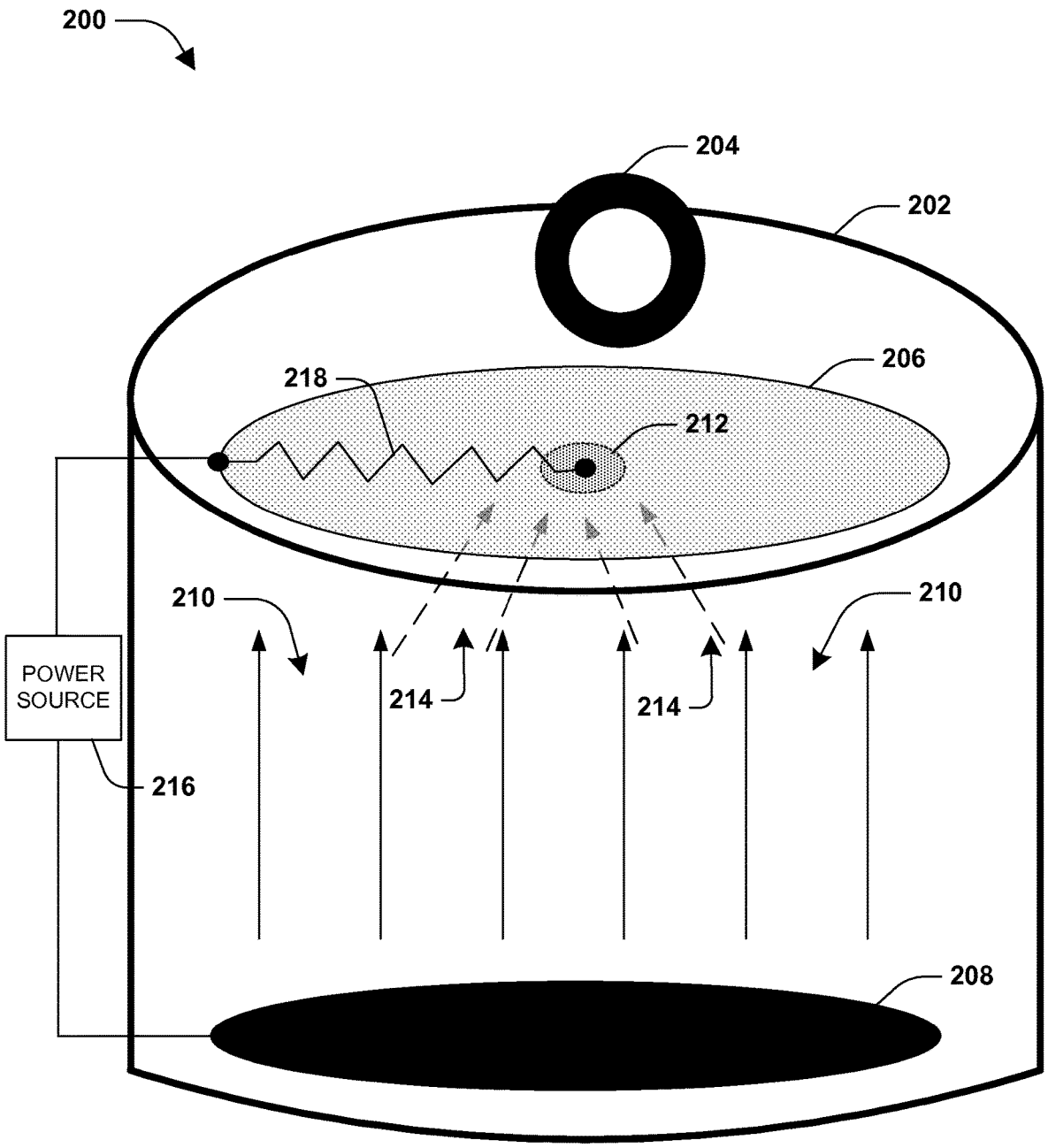
FIG. 2A is an illustration of a system for promoting metal plating profile uniformity using a magnetic structure positioned outside a plating cell, according to some embodiments.

FIG. 2A illustrates a system 200 for promoting metal plating profile uniformity. The system 200 comprises a magnetic structure 204. The magnetic structure 204 is positioned at a first position with respect to a semiconductor wafer 206 within a plating cell 202. In an embodiment, the magnetic structure 204 is positioned outside the plating cell 202. In an embodiment, the magnetic structure 204 is positioned above the semiconductor wafer 206 such that the semiconductor wafer 206 is between the magnetic structure 204 and an anode 208 within the plating cell 202. It is appreciated that the magnetic structure 204 has any shape, size, or placement. A power source 216 is connected to the anode 208 and to a wafer edge of the semiconductor wafer 206 which acts as a cathode. The plating cell 202 comprises an electrolyte solution used to facilitate a metal plating process performed to electroplate metal onto the semiconductor wafer 206. When active, the power source 216 generates an electrical plating current 210 that provides electrons that convert metal ions, within the electrolyte solution, to metal atoms that accumulate on the surface of the semiconductor wafer 206. In an embodiment, a seed layer, such as a copper layer, is formed over a surface of the semiconductor wafer 206 to facilitate the metal plating process. The seed layer has a wafer resistance 218 between the wafer edge and a center portion of the semiconductor wafer 206, which results in a voltage drop between the wafer edge and the center portion. The voltage drop leads to a terminal effect that reduces electrical plating current 210 that reaches the center portion thus resulting in greater accumulation of metal atoms at the wafer edge than the center portion.

Accordingly, the magnetic structure 204 is used during the metal plating process to modify the electrical plating current 210. The magnetic structure 204, at the first position above the semiconductor wafer 206, creates a magnetic field 212 proximate the center portion of the semiconductor 206. In an embodiment, the magnetic field 212 applies a force, such as an attractive force, to metal ions so that that metal ions are moved 214 toward the center portion of the semiconductor wafer 206. In an embodiment, the magnetic structure increase increases a center plating current associated with the center portion of the semiconductor wafer 206. In this way, the center plating current has a current value similar to an edge plating current value such that the effect of the wafer resistance 218 is generally negated. The similarity between the center plating current and the edge plating current promotes metal plating uniformity. It is appreciated that an embodiment of a center plating current 454 and an edge plating current 452 is illustrated in FIG. 4B.

Figure 2B:
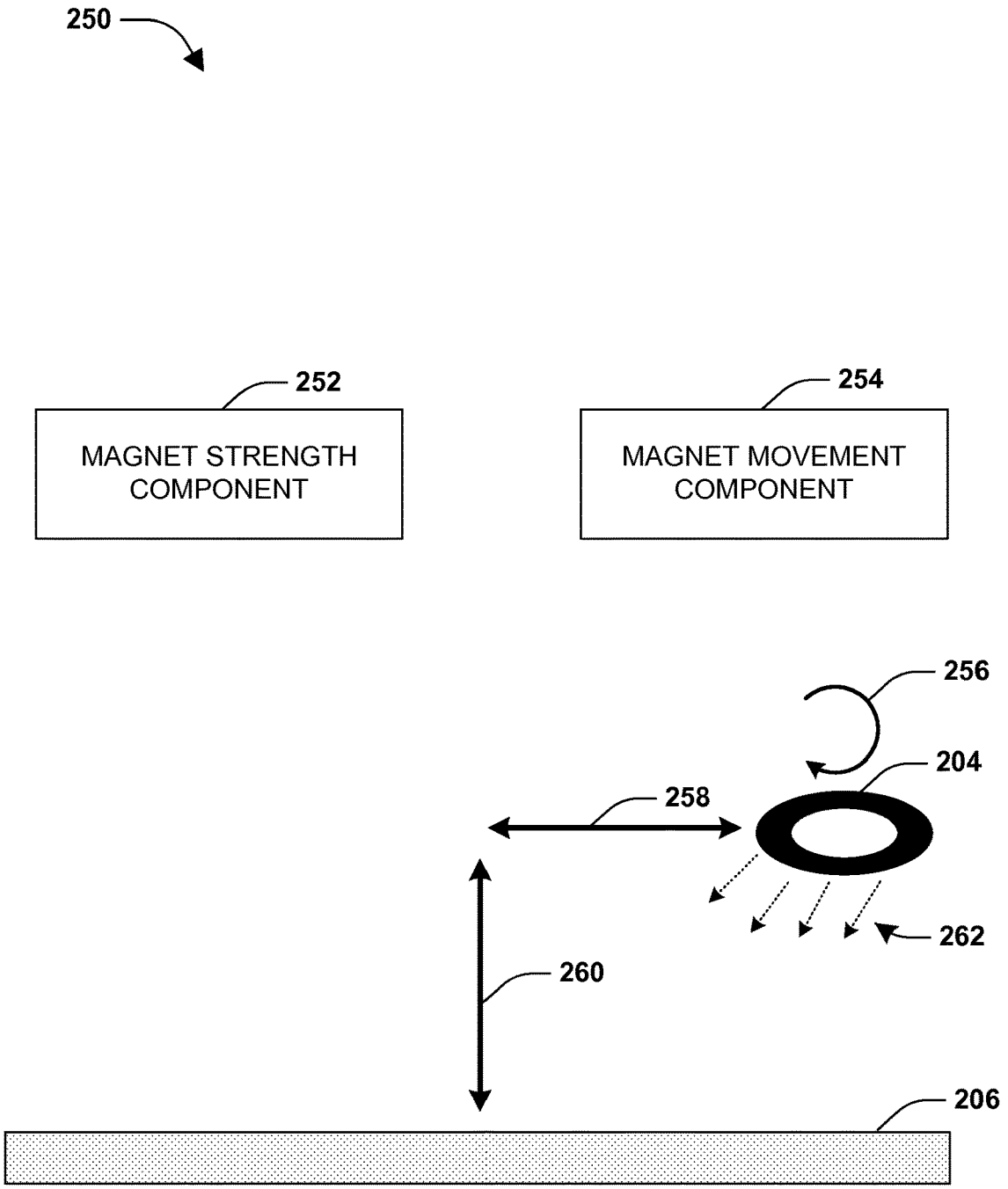
FIG. 2B is an illustration of a cross-sectional view of a system for promoting metal plating profile uniformity using a magnetic structure positioned outside a plating cell, according to some embodiments.

FIG. 2B illustrates a system 250 for modifying a magnetic structure 204 during a metal plating process. In an embodiment, the magnetic structure 204 corresponds to the magnetic structure 204 of FIG. 2A such that FIG. 2B is a cross-sectional view of system 200 where the magnetic structure 204 is positioned above a semiconductor wafer 206. The system 250 comprises a magnet strength component 252. The magnet strength component 252 is configured to modify a strength of a magnetic field 262 generated by the magnetic structure 204. In an embodiment where the magnetic structure 204 is an electromagnet, the magnet strength component 252 is configured to modify a power or current setting of the electromagnet to adjust the strength of the magnetic field 262.

The system 250 comprises magnet movement component 254. In an embodiment, the magnet movement component 254 is configured to rotate 256 the magnetic structure 204 with respect to the semiconductor wafer 206. The magnet movement component 254 is configured to modify a rotational speed of the magnetic structure 204. In an embodiment, the magnet movement component 254 is configured to modify a position of the magnetic structure 204 in a vertical direction 260 with respect to the surface of the semiconductor wafer 206. In an embodiment, the magnet movement component 254 is configured to modify a position of the magnetic structure 204 in a horizontal direction 258 with respect to a center of the semiconductor wafer 206. Modifying at least one of the magnetic strength of the magnetic field 262 or the position of the magnetic structure 204 relative to the semiconductor wafer 206 allows control to be exercised over plating current to promote a desired metal plating profile across the semiconductor wafer 206.

Figure 3A:
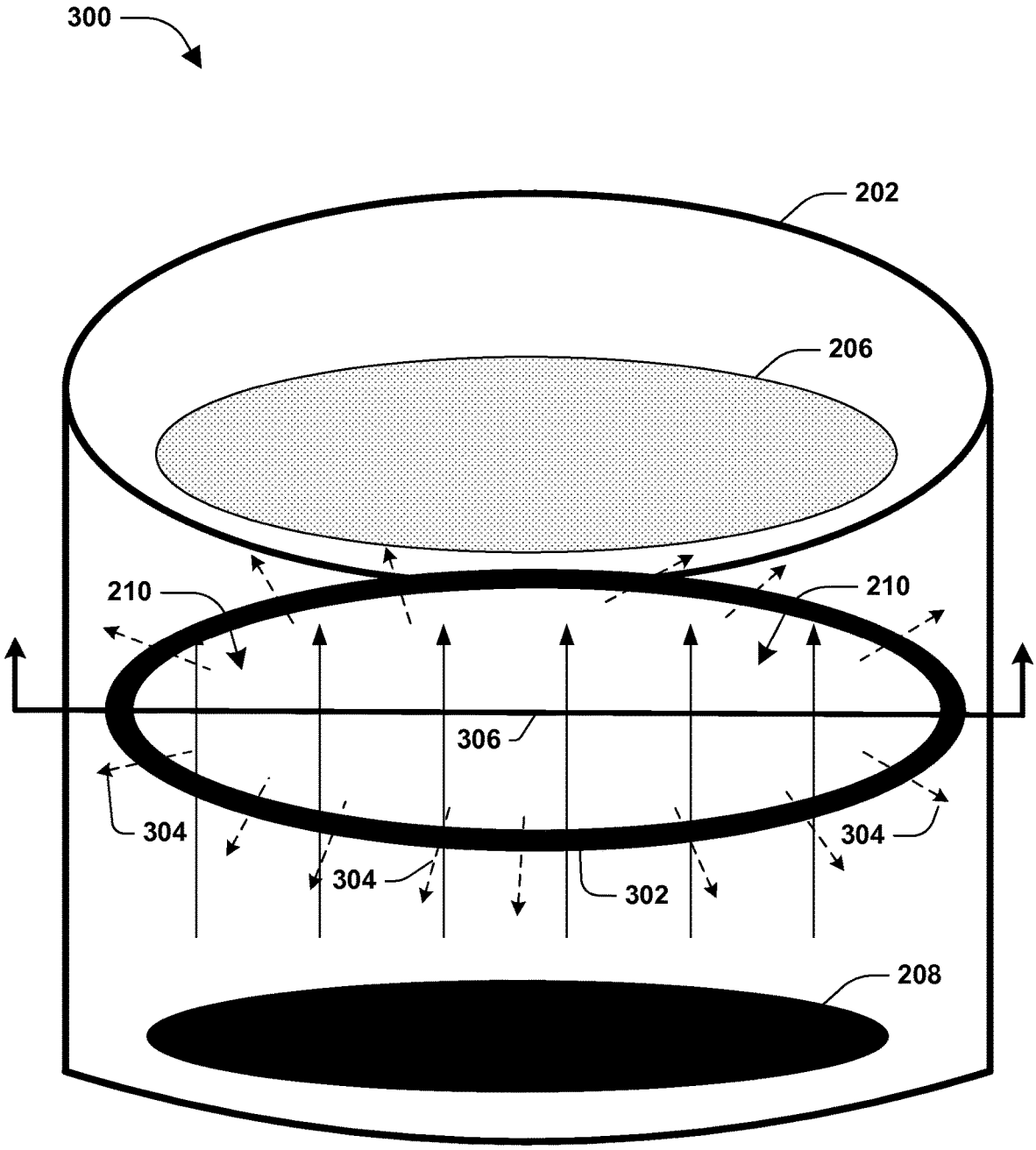
FIG. 3A is an illustration of a system for promoting metal plating profile uniformity using a magnetic structure positioned inside a plating cell, according to some embodiments.

FIG. 3A illustrates a system 300 for promoting metal plating profile uniformity, where a magnetic structure 302 is used in a metal plating process to promote metal plating uniformity. In an embodiment, the magnetic structure 302 is formed according to a single structure, such as a continuous ring. In an embodiment, the magnetic structure 302 is positioned within a plating cell 202 within which a semiconductor wafer 206 is to be electroplated by a metal plating process using an electrical plating current 210. In an embodiment, the magnetic structure 302 is positioned between the semiconductor wafer 206 and an anode 208 comprised within the plating cell 202. It is appreciated that the magnetic structure 302 has any shape, size, or placement. The magnetic structure 302 is configured to apply a force to metal ions to move 304 the metal ions away from a wafer edge of the semiconductor wafer 206. In an embodiment, the magnetic structure 302 moves 304 the metal ions away from the wafer edge and towards a housing of the plating cell 202. In an embodiment, the magnetic structure 302 moves the metal ions away from the wafer edge and towards a center portion of the semiconductor wafer 206. In an embodiment, the magnetic structure 302 provides a magnetic force that decreases an edge plating current such that the edge plating current has a current value similar to a current value of a center plating current. The similarity between the center plating current and the edge plating current promotes metal plating uniformity. It is appreciated that an embodiment of a center plating current 454 and an edge plating current 452 is illustrated in FIG. 4B.

Figure 3B:
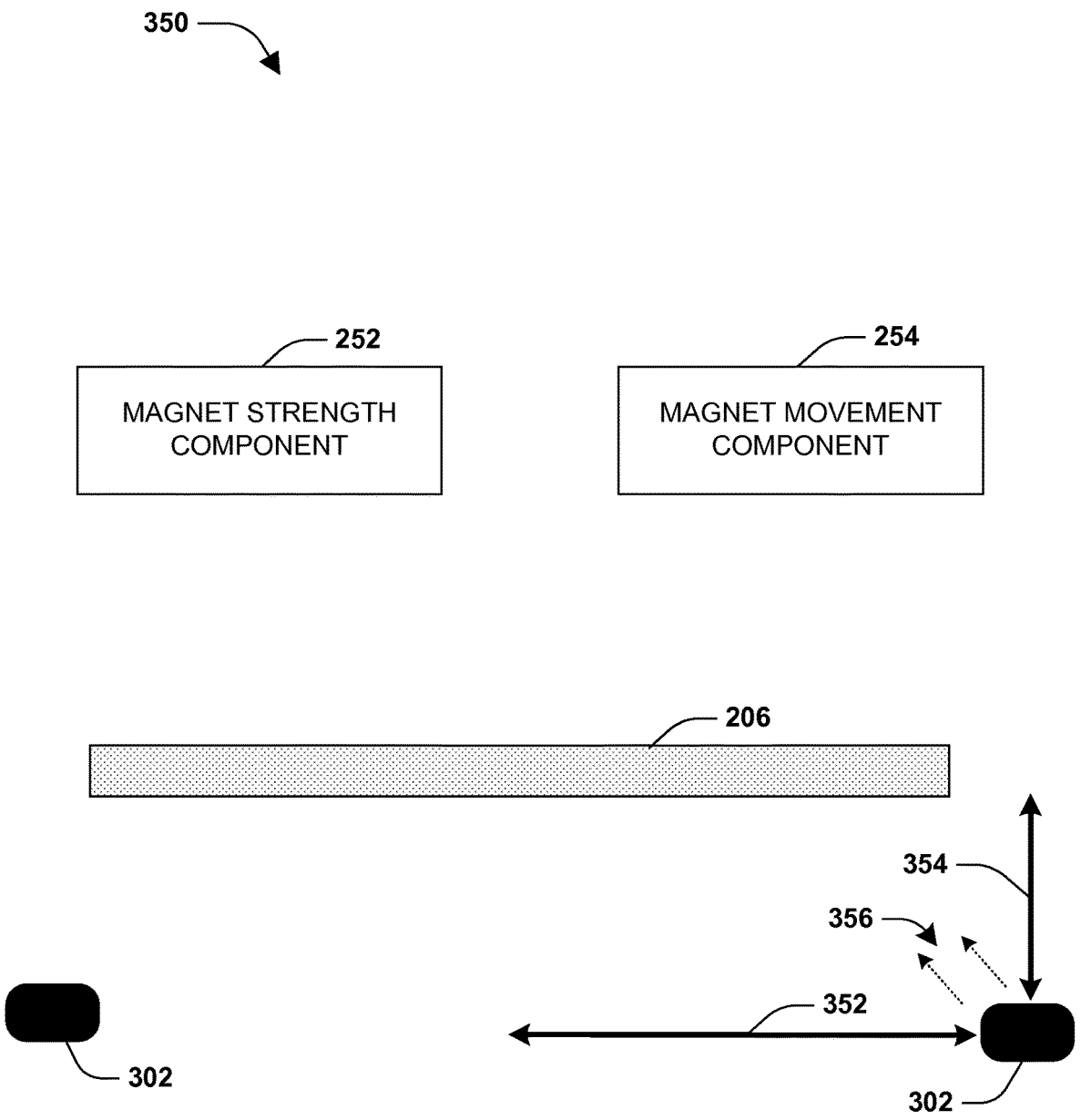
FIG. 3B is an illustration of a cross-sectional view of a system for promoting metal plating profile uniformity using a magnetic structure positioned inside a plating cell, according to some embodiments.

FIG. 3B illustrates a system 350 for modifying a magnetic structure 302 during a metal plating process. In an embodiment, the magnetic structure 302 corresponds to the magnetic structure 302 of FIG. 3A such that FIG. 3B is a cross-sectional view illustrating magnetic structure 302 and the semiconductor wafer 206 along line 306 of FIG. 3A. The system 350 comprises a magnet strength component 252. The magnet strength component 252 is configured to modify a strength of a magnetic field 356 generated by the magnetic structure 302, such as by modifying at least one of a power or a current for the magnetic structure 302. The system 350 comprises a magnet movement component 354. In an embodiment, the magnet movement component 254 is configured to modify a position of the magnetic structure 302 in a vertical direction 354 with respect to the surface of the semiconductor wafer 206. In an embodiment, the magnet movement component 254 is configured to modify a position of the magnetic structure 302 in a horizontal direction 352 with respect to a center of the semiconductor wafer 206. Modifying at least one of the magnetic strength of the magnetic field 356 or the position of the magnetic structure 302 relative to the semiconductor wafer 206 allows control to be exercised over plating current to promote a desired metal plating profile across the semiconductor wafer 206.

Figure 4A:
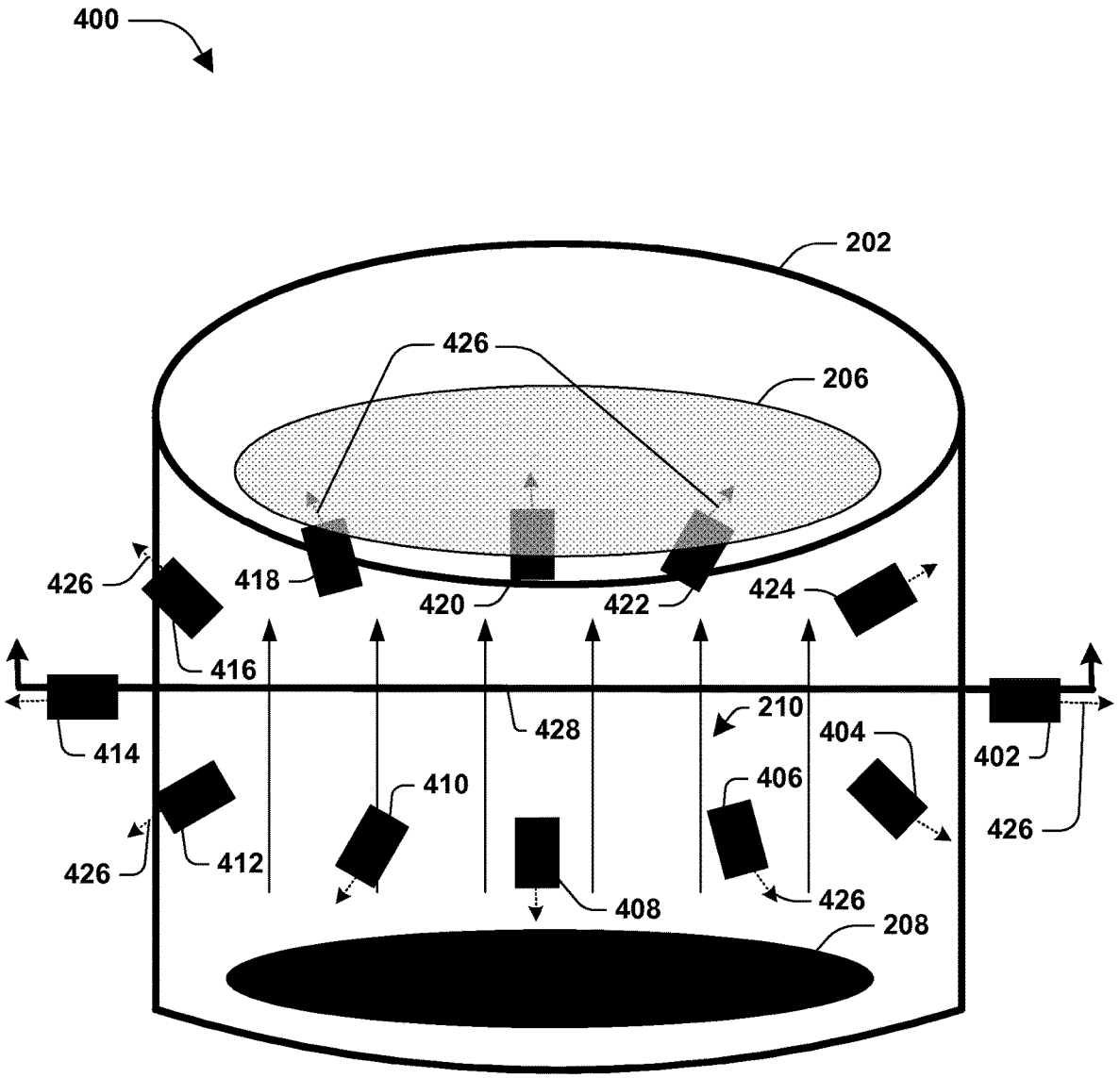
FIG. 4A is an illustration of a system for promoting metal plating profile uniformity using a magnetic structure comprising one or more magnetic portions positioned outside a plating cell, according to some embodiments.
Figure 4B:
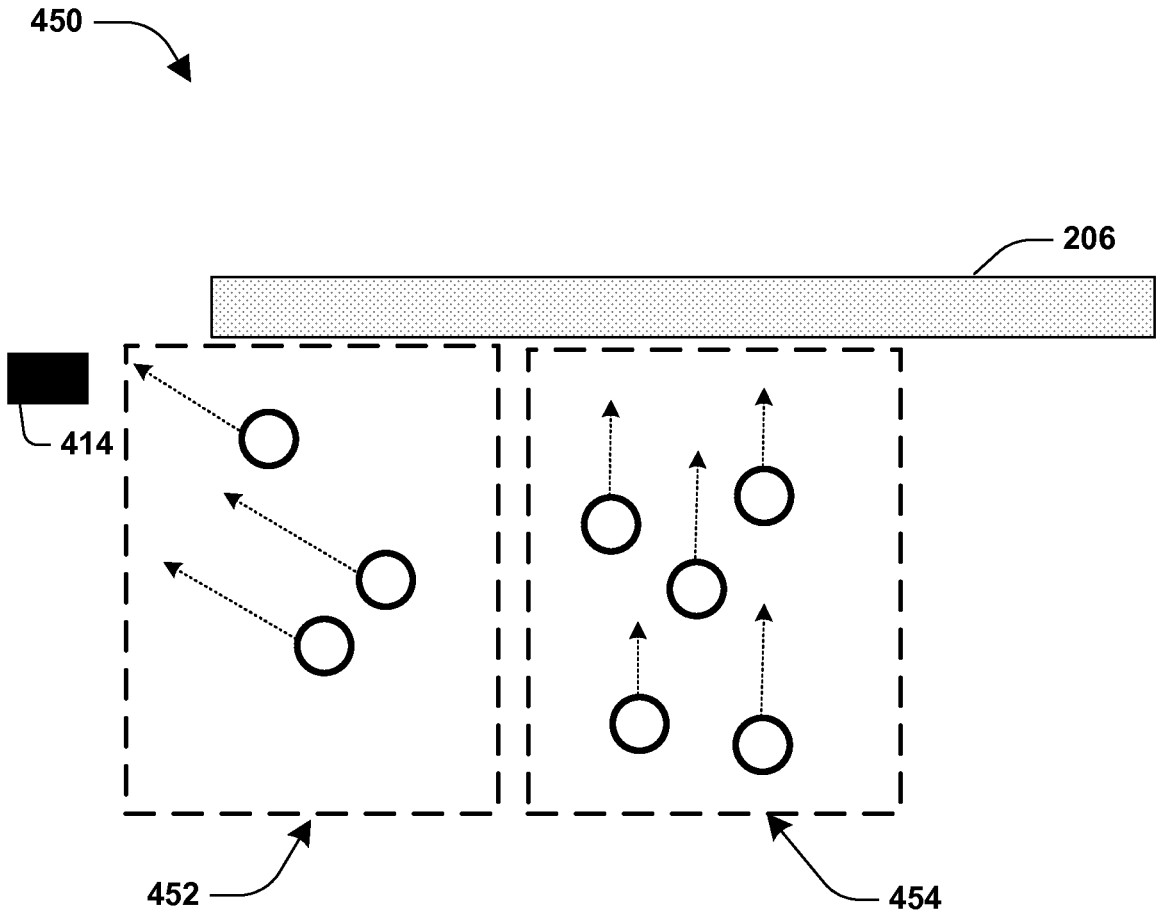
FIG. 4B is an illustration of a cross-sectional view of a system for promoting metal plating profile uniformity using a magnetic structure comprising one or more magnetic portions positioned outside a plating cell, according to some embodiments.

FIG. 4A illustrates a system 400 for promoting metal plating profile uniformity, where a magnetic structure is used in a metal plating process to promote metal plating uniformity. In an embodiment, the magnetic structure comprising a plurality of magnetic portions. In an embodiment, the magnetic structure comprises a first magnetic portion 402, a second magnetic portion 404, a third magnetic portion 406, a fourth magnetic portion 408, a fifth magnetic portion 410, a sixth magnetic portion 412, a seventh magnetic portion 414, an eighth magnetic portion 416, a ninth magnetic portion 418, a tenth magnetic portion 420, an eleventh magnetic portion 422, and a twelfth magnetic portion 424. It is appreciated that the magnetic structure comprises any number of magnetic portions, and such magnetic portions have any shape, size, distribution, or arrangement. In an embodiment, the magnetic structure is positioned outside a plating cell 202 within which a semiconductor wafer 206 is to be electroplated by a metal plating process using an electrical plating current 210. In an embodiment, the magnetic structure is positioned around the plating cell 202. In an embodiment, the magnetic structure is positioned around the semiconductor wafer 206. In an embodiment, the magnetic structure is configured to apply a force to metal ions to move the metal ions away from a wafer edge of the semiconductor wafer 206. In an embodiment, the magnetic structure pulls the metal ions away from the wafer edge in a direction towards a housing of the plating cell 202, as illustrated by arrows 426. In an embodiment, the magnetic structure provides a magnetic force that decreases an edge plating current such that the edge plating current has a current value similar to a current value of a center plating current. The similarity between the center plating current and the edge plating current promotes metal plating uniformity. It is appreciated that an embodiment of a center plating current 454 and an edge plating current 452 is illustrated in FIG. 4B.

FIG. 4B illustrates a cross-sectional view 450 depicting the seventh magnetic portion 414 and the semiconductor wafer 206 along line 428 of FIG. 4A, but where the other magnetic portions are not depicted for simplicity. The seventh magnetic portion 414 is configured to move metal ions away from a wafer edge of the semiconductor wafer 206, such as metal ions associated with an edge plating current 452. Because the seventh magnetic portion 414 is positioned closer to the wafer edge than a center portion of the semiconductor wafer 206, the seventh magnetic portion 414 has substantially no effect on metal ions associated with a center plating current 454. In this way, the edge plating current 452 is decreased so that the edge plating current 452 has a current value similar to a current value of the center plating current 454. The similarity between the center plating current 454 and the edge plating current 452 promotes metal plating uniformity resulting from a metal plating process performed on the semiconductor wafer 206.

According to an aspect of the instant disclosure, a system for promoting metal plating profile uniformity is provided. The system comprises a magnetic structure that is positioned at a first position with respect to a semiconductor wafer that is to be electroplated with metal during a metal plating process. The magnetic structure is configured to modify at least one of an edge plating current or a center plating current associated with the metal plating process.

According to an aspect of the instant disclosure, a method for promoting metal plating profile uniformity is provided. The method comprises positioning a magnetic structure at a first position with respect to a semiconductor wafer that is to be electroplated with metal during a metal plating process. A force is applied using the magnetic structure. In an embodiment, the force decreases an edge plating current associated with the metal plating process. In another embodiment, the force increases a center plating current associated with the metal plating process.

According to an aspect of the instant disclosure, a system for promoting metal plating profile uniformity is provided. The system comprises a plating cell configured to perform a metal plating process upon a semiconductor wafer. The system comprises a magnetic structure configured to apply a force with respect to a metal plating current associated with the metal plating process. In an embodiment, the force decreases an edge plating current associated with the metal plating process. In another embodiment, the force increases a center plating current associated with the metal plating process.

Although the subject matter has been described in language specific to structural features or methodological acts, it is to be understood that the subject matter of the appended claims is not necessarily limited to the specific features or acts described above. Rather, the specific features and acts described above are disclosed as embodiment forms of implementing at least some of the claims.

Various operations of embodiments are provided herein. The order in which some or all of the operations are described should not be construed to imply that these operations are necessarily order dependent. Alternative ordering will be appreciated given the benefit of this description. Further, it will be understood that not all operations are necessarily present in each embodiment provided herein. Also, it will be understood that not all operations are necessary in some embodiments.

It will be appreciated that layers, features, elements, etc. depicted herein are illustrated with particular dimensions relative to one another, such as structural dimensions or orientations, for example, for purposes of simplicity and ease of understanding and that actual dimensions of the same differ substantially from that illustrated herein, in some embodiments.

Further, unless specified otherwise, "first," "second," or the like are not intended to imply a temporal aspect, a spatial aspect, an ordering, etc. Rather, such terms are merely used as identifiers, names, etc. for features, elements, items, etc. For example, a first channel and a second channel generally correspond to channel A and channel B or two different or two identical channels or the same channel.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application are generally to be construed to mean "one or more" unless specified otherwise or clear from context to be directed to a singular form. Also, at least one of A and B or the like generally means A or B or both A and B. Furthermore, to the extent that "includes", "having", "has", "with", or variants thereof are used, such terms are intended to be inclusive in a manner similar to "comprising".

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A system for promoting metal plating profile uniformity, comprising:

a plating cell configured to contain a semiconductor wafer, wherein, when the semiconductor wafer is disposed within the plating cell, a bottom surface of the semiconductor wafer faces an anode;

a circular-shaped magnetic structure configured to modify at least one of an edge plating current or a center plating current associated with a metal plating process for the semiconductor wafer; and a magnet movement component configured to modify a position of the circular-shaped magnetic structure from a first position to a second position with respect to the semiconductor wafer by moving the circular-shaped magnetic structure in a first direction and rotating the circular-shaped magnetic structure about an axis parallel to a diameter of the circular-shaped magnetic structure, wherein the circular-shaped magnetic structure is entirely disposed between a center of the semiconductor wafer and an edge of the semiconductor wafer when the circular-shaped magnetic structure is positioned at the second position.

2. The system of claim 1, the circular-shaped magnetic structure configured to:

provide a magnetic force to decrease the edge plating current.

3. The system of claim 1, the circular-shaped magnetic structure configured to:

provide a magnetic force to increase the center plating current.

4. The system of claim 1, the circular-shaped magnetic structure configured to:

apply a force to a metal ion to move the metal ion towards a center portion of the semiconductor wafer.

5. The system of claim 1, the circular-shaped magnetic structure configured to:

apply a force to a metal ion to move the metal ion away from a wafer edge of the semiconductor wafer.

6. The system of claim 1, the circular-shaped magnetic structure located externally to the plating cell.

7. The system of claim 6, the circular-shaped magnetic structure configured to:

apply a force to a metal ion to move the metal ion away from a wafer edge of the semiconductor wafer proximate a housing of the plating cell.

8. The system of claim 1, the circular-shaped magnetic structure located inside the plating cell.

9. The system of claim 1, the circular-shaped magnetic structure located relative to the semiconductor wafer such that the semiconductor wafer is situated between the circular-shaped magnetic structure and the anode.

10. The system of claim 9, the circular-shaped magnetic structure configured to:

apply a force to a metal ion generated by the anode to move the metal ion towards a center portion of the semiconductor wafer.

11. The system of claim 1, the magnet movement component configured to:

modify a rotational speed of the circular-shaped magnetic structure.

12. The system of claim 1, a difference between the first position and the second position corresponding to a change in a horizontal distance between the circular-shaped magnetic structure and the center of the semiconductor wafer.

13. The system of claim 1, comprising:

a magnet strength component configured to:

modify a strength of a magnetic field generated by the circular-shaped magnetic structure.

14. The system of claim 1, wherein the diameter of the circular-shaped magnetic structure is less than a diameter of the semiconductor wafer.

15. The system of claim 1, wherein the circular-shaped magnetic structure defines a ring.

16. A system for promoting metal plating profile uniformity, comprising:

a plating cell configured to perform a metal plating process upon a semiconductor wafer, wherein when the semiconductor wafer is disposed within the plating cell, a bottom surface of the semiconductor wafer faces an anode; and a ring-shaped magnetic structure having a diameter that is less than a diameter of the semiconductor wafer, wherein the ring-shaped magnetic structure is configured to apply a force to at least one of:

decrease an edge plating current associated with the metal plating process, or increase a center plating current associated with the metal plating process; and a magnet movement component configured to modify a position of the ring-shaped magnetic structure from a first position to a second position with respect to the semiconductor wafer by moving the ring-shaped magnetic structure in a first direction and rotating the ring-shaped magnetic structure about an axis parallel to the diameter of the ring-shaped magnetic structure, wherein the ring-shaped magnetic structure is entirely disposed between a center of the semiconductor wafer and an edge of the semiconductor wafer when the ring-shaped magnetic structure is positioned at the second position.

17. A system for promoting metal plating profile uniformity, comprising:

a metal plating cell configured to contain a semiconductor wafer having a first surface to be plated;

a circular-shaped magnetic structure configured to generate a magnetic field that interacts with metal ions within the metal plating cell; and a magnet movement component configured to move the circular-shaped magnetic structure between a first position at which the circular-shaped magnetic structure is substantially centered over the semiconductor wafer to a second position at which the circular-shaped magnetic structure is entirely disposed between a center of the semiconductor wafer and an edge of the semiconductor wafer and to rotate the circular-shaped magnetic structure about an axis parallel to a diameter of the circular-shaped magnetic structure.

18. The system of claim 17, the magnetic movement component configured to move the circular-shaped magnetic structure in a direction perpendicular to the first surface of the semiconductor wafer.

19. The system of claim 17, wherein the circular-shaped magnetic structure configured is to provide a magnetic force to increase a center plating current to direct the metal ions toward the center of the semiconductor wafer.

20. The system of claim 17, wherein the semiconductor wafer is disposed between an anode and the circular-shaped magnetic structure.

* * * * *